United States Patent [19]

Walker, Jr. et al.

[11] 4,129,459

[45] Dec. 12, 1978

[54] METHOD FOR DIMINISHING THE STRENGTH AND DUCTILITY OF STEEL UTILIZING A LITHIUM-INDIUM-AMALGAM CONTAINING A SMALL AMOUNT OF VANADIUM PENTOXIDE

[75] Inventors: Clarence H. Walker, Jr., Phoenix, Ariz.; John D. Corrie, Philadelphia, Pa.

[73] Assignee: The United States of America as represented by the Secretary of the Army, Washington, D.C.

[21] Appl. No.: 576,502

[22] Filed: Aug. 25, 1966

[51] Int. Cl.[2] ..... C23C 1/10; C22C 7/00; B26F 3/00

[52] U.S. Cl. ..... 148/4; 75/169; 148/22; 225/2

[58] Field of Search ..... 148/22, 4, 6, 6.27; 83/1; 156/18; 117/130; 75/169; 225/2

[56] References Cited

U.S. PATENT DOCUMENTS

| | | | |
|---|---|---|---|
| 3,969,154 | 7/1976 | Collins | 148/9 R |
| 4,045,356 | 8/1977 | Eisner | 148/6 X |

*Primary Examiner*—Richard E. Schafer

*Attorney, Agent, or Firm*—Nathan Edelberg; Harold H. Card, Jr.; A. Victor Erkkila

[57] ABSTRACT

New reactants for catastrophically embrittling steel having a hardness of Rockwell C40 or greater comprising an amalgam of 98 to 99 weight percent mercury, the balance being lithium and indium; and an aqueous solution of vanadium pentoxide, and methods for applying said reactants to the steel.

4 Claims, 1 Drawing Figure

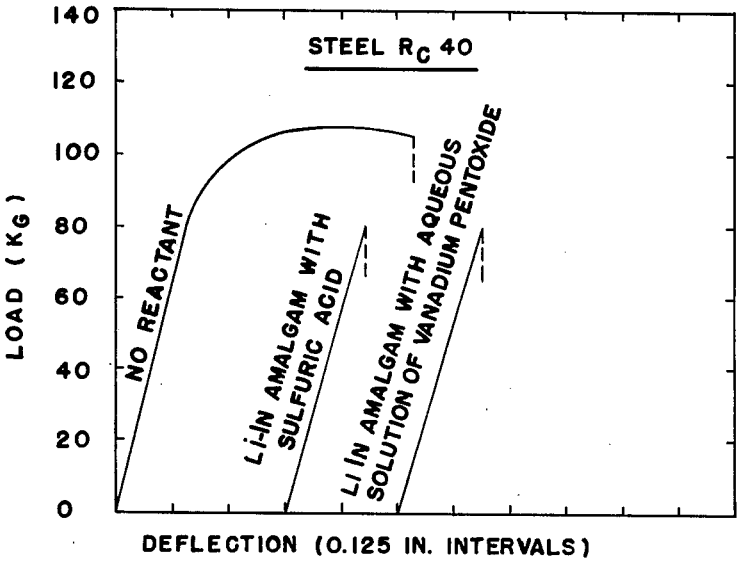
INVENTOR.
CLARENCE H. WALKER, JR.
JOHN D. CORRIE
BY Harry M. Saragovitz
Edward J. Kelly, Herbert Berl
& S. Dubroff
ATTORNEYS

METHOD FOR DIMINISHING THE STRENGTH AND DUCTILITY OF STEEL UTILIZING A LITHIUM-INDIUM-AMALGAM CONTAINING A SMALL AMOUNT OF VANADIUM PENTOXIDE

This invention relates to improved reactants for use with treating steels to diminish the strength and ductility thereof, and particularly to improved reactants for use with treating steels having hardnesses of Rockwell C40 or greater to cause catastrophic embrittlement thereof.

The embrittling effect of liquid metals on steel decreases with decreasing strength or hardness of the steel. The best reactant available is that described and claimed in the copending application of Clarence H. Walker, Jr. and William B. Steward, Jr., Ser. No. 576,178. This reactant consists essentially of an amalgam of mercury, lithium, and indium plus a small amount of concentrated sulfuric acid intimately commingled with the amalgam. The acid acts to promote the wetting of the steel by the amalgam. This reactant is liquid at room temperature and when applied to steels having hardnesses of Rockwell C40 or greater will cause catastrophic embrittlement thereof. Catastrophic embrittlement occurs when a metal is caused to fail below its yield strength. This means, in essence, that the metal has been made brittle and will not take a permanent or plastic deformation. This reactant just described, however, has an inherent disadvantage in that it requires the use of concentrated sulfuric acid which, because of its highly caustic nature, demands special care and precaution in handling.

It is therefore an object of the present invention to provide a reactant which will cause catastrophic embrittlement of steels having hardnesses of Rockwell C40 or greater. Another object of the present invention is to provide a reactant of the type described which uses a non-caustic liquid chemical portion. It is still another object of the present invention to provide a reactant of the type described which will cause the embrittlement at room temperature. Yet another object of the present invention is to provide a reactant of the type described which is capable of mixture of the amalgam portion and the liquid chemical portion prior to application, thereby permitting storage of the reactant. Still another object of the present invention is to provide a reactant of the type described which may be used together with a projectile to defeat steel armor plate. Further objects and advantages of the present invention will become apparent to those skilled in the art from the following discussion and appended claims.

In accordance with the present invention the above objects are accomplished by a reactant consisting of a liquid metal portion, or what is commonly called an amalgam, of mercury, indium and lithium; and a small amount of an aqueous solution of vanadium pentoxide. The amalgam is old, having been developed earlier and disclosed in said copending application, as previously pointed out. The use of the vanadium pentoxide in lieu of concentrated sulfuric acid is the point of novelty of the present invention. The prime advantage to the use of vanadium pentoxide is that it may be handled without danger of harm. The results on steels of the present inventive reactant is substantially the same as that of the reactant using concentrated sulfuric acid; that is, when steels having hardnesses of Rockwell C40 or greater are treated with the inventive reactant, catastrophic embrittlement results.

The compositions, and their ranges, of the amalgam portion of the inventive reactant in weight percentages are as follows:

Mercury: 98 to 99
Indium: 0.25 to 0.75
Lithium: 0.75 to 1.25

The above amalgams are made according to the following procedure, using mercury, solid indium and solid lithium. Appropriate amounts of small indium chips are dissolved into the mercury. After the mercury and indium are well mixed small chips of solid lithium, in the correct amount, are added. Upon dissolution of the lithium chips into the mercury-indium amalgam, the reactant is ready for use. When the indium is added to the mercury before the lithium, the lithium appears to dissolve more rapidly. Dissolution of the lithium into the mercury-indium amalgam can be hastened by mild heating, but it is not necessary. In appearance the mercury-indium-lithium amalgam is a silvery paste.

The liquid chemical portion of the present inventive reactant consists of a saturated solution of vanadium pentoxide ($V_2O_5$). This saturated solution forms vanadic acid ($H_4V_2O_7$) with solubility of 0.08gms of $V_2O_5$ per 100 ml or water. It is light yellow or rust in color and appears to be very acidic (approximately pH 2) when tested with Alkacid test Ribbon. However, it does not have the characteristics of a strong acid, such as stringent odor, toxic fumes etc. There is practically no odor and it doesn't attack the fingers if wet with it.

A small amount of the vanadium pentoxide solution is added to the liquid metal or amalgam portion. Thus vanadium pentoxide solution aids in causing amalgam to wet the steel to which it is applied. The exact reason for this is not known. Besides aiding wetting by the amalgam, it is not harmful if brought into contact with the skin.

The exact amount of vanadium pentoxide solution necessary is not known. An amount as small as one drop per one gram of amalgam will produce the results of causing the amalgam to wet steel. Increasing the amount of vanadium pentoxide solution neither adds nor detracts from the ability of the amalgam to wet steel. It is possible that a very small, practically immeasurable quantity of the vanadium pentoxide solution reacts with the inventive amalgam to produce a composition of matter which provides the known result of improved wetting. However it may be, the significance here is that only a very small amount of vanadium pentoxide solution is required, which amount can be readily ascertained by those skilled in this art.

An added advantage of using vanadium pentoxide solution is that it may be commingled with the amalgam portion prior to application of the reactant with a steel sample, thus enabling the reactant (amalgam plus vanadium pentoxide) to be stored in suitable containers. On the other hand, the concentrated sulfuric acid could not be added to the amalgam portion until the time of an application with a steel sample. In other words, the sulfuric acid and amalgam had to remain in separate containers until a specific application of the reactant was desired.

Samples of steel were treated with a reactant of the present invention consisting of an amalgam of mercury in an amount of 98.5 weight percent, lithium in an amount of 1.0 weight percent, and indium in an amount of 0.5 weight percent; together with a small amount of the aqueous solution of vandium pentoxide intimately commingled with the amalgam. A similar steel sample was treated with a reactant consisting of an amalgam having the same mercury-lithium-indium weight proportions of the inventive reactant used in this test, plus a small amount of concentrated sulfuric acid. The treated samples were compared with an untreated one. In all cases the hardness of the steel samples was Rockwell C40. The samples were subjected to standard laboratory bend tests. The single FIGURE shows the results of the tests. As can be seen the inventive reactant produced a 28 percent reduction in load and a 70 percent reduction in deflection-to-failure. These results are essentially the same as those obtained on the steel sample using concentrated sulfuric acid reactant. The above results were obtained at room temperature conditions.

Various modifications and alterations of this invention will become apparent to those skilled in this art without departing from the scope and spirit of this invention, and the foregoing discussion should not be construed to unduly limit this invention.

We claim:

1. In a method for diminishing the strength and ductility of steel comprising contacting said steel with a reactant consisting essentially of an amalgam containing about 0.75 to 1.25 weight percent lithium, 0.25 to 0.75 weight percent indium, and about 98 to 99 weight percent mercury, the improvement comprising intimately commingling with said amalgam a small amount of an aqueous solution of vanadium pentoxide.

2. A method according to claim 1 wherein said lithium content is about 1.0 weight percent. said indium content is about 0.5 weight percent, and said mercury content is about 98.5 weight percent.

3. A reactant for diminishing the strength and ductility of steel consisting essentially of a small amount of an aqueous solution of vanadium pentoxide intimately commingled with an amalgam consisting essentially of about 0.75 to 1.25 weight percent lithium, 0.25 to 0.75 weight percent indium, and about 98 to 99 weight percent mercury.

4. A reactant according to claim 3 wherein said lithium content is about 1.0 weight percent, said indium content is about 0.5 weight percent, and said mercury content is about 98.5 weight percent.

* * * * *